US012390693B2

(12) United States Patent
Repiquet

(10) Patent No.: US 12,390,693 B2
(45) Date of Patent: Aug. 19, 2025

(54) AQUATIC PROPULSION DEVICE

(71) Applicant: S.C.P. PHORCYS Diving, Monaco (MC)

(72) Inventor: Yann-Philippe Repiquet, Menton (FR)

(73) Assignee: S.C.P. PHORCYS DIVING, Monaco (MC)

( * ) Notice: Subject to any disclaimer, the term of this patent is extended or adjusted under 35 U.S.C. 154(b) by 0 days.

(21) Appl. No.: 18/865,217

(22) PCT Filed: May 10, 2023

(86) PCT No.: PCT/EP2023/062489

§ 371 (c)(1),
(2) Date: Nov. 12, 2024

(87) PCT Pub. No.: WO2023/217898

PCT Pub. Date: Nov. 16, 2023

(65) Prior Publication Data

US 2025/0108263 A1 Apr. 3, 2025

(30) Foreign Application Priority Data

May 12, 2022 (MC) ..... 2715

(51) Int. Cl.
*A63B 31/12* (2006.01)

(52) U.S. Cl.
CPC ..... *A63B 31/12* (2013.01); *A63B 2209/02* (2013.01); *A63B 2210/50* (2013.01)

(58) Field of Classification Search
CPC ..... A63B 31/00; A63B 31/08; A63B 31/10; A63B 31/11; A63B 2031/112; A63B 2031/115; A63B 2031/117; A63B 31/12
USPC ..... 441/55, 60, 61, 62, 63, 64
See application file for complete search history.

(56) References Cited

U.S. PATENT DOCUMENTS 3,268,927 A 8/1966 Markowitz
5,531,621 A * 7/1996 Johnson ..... A63B 31/14 441/61
5,645,460 A * 7/1997 Johnson ..... A63B 31/14 441/63

(Continued)

FOREIGN PATENT DOCUMENTS

WO 2016/094930 A1 6/2016

OTHER PUBLICATIONS

International Search Report issued in PCT/EP2023/062489; mailed Jul. 31, 2023.

(Continued)

*Primary Examiner* — Daniel V Venne
(74) *Attorney, Agent, or Firm* — Studebaker Brackett PLLC

(57) ABSTRACT

An aquatic propulsion device to be worn by a swimmer includes a first portion to be securely attached to the leg of the swimmer, which includes a bearing part having an inner face shaped so as to bear on the tibia of the swimmer and an outer face opposite to the inner face; a second portion including a first foil and a foil support, the first foil being secured to the foil support and the foil support enabling rotational articulation of the second portion relative to the first portion according to a first axis so as to make the device alternately switch from a deployed configuration into a retracted configuration.

20 Claims, 5 Drawing Sheets

(56) References Cited

U.S. PATENT DOCUMENTS

| | | | | | |
|---|---|---|---|---|---|
| 6,126,502 | A | * | 10/2000 | Hull | A63B 31/11 441/63 |
| 6,129,601 | A | * | 10/2000 | Aucoin | A63B 31/11 441/64 |
| 6,702,633 | B1 | * | 3/2004 | Johnson | A63B 31/11 441/64 |
| 8,678,870 | B2 | * | 3/2014 | Johnson | A63B 31/12 441/60 |
| 9,457,231 | B2 | * | 10/2016 | Rodgers, Jr. | A63B 31/11 |
| 2003/0036322 | A1 | | 2/2003 | Wilson | |
| 2010/0075554 | A1 | | 3/2010 | Johnson | |
| 2011/0104968 | A1 | | 5/2011 | Johnson | |
| 2017/0007888 | A1 | | 1/2017 | Stroud | |

OTHER PUBLICATIONS

Written Opinion of the International Searching Authority issued in PCT/EP2023/062489; mailed Jul. 31, 2023.

* cited by examiner

AQUATIC PROPULSION DEVICE

TECHNICAL FIELD OF THE INVENTION

The present invention relates to the field of finning devices. It finds a particularly advantageous application in the field of scuba diving.

PRIOR ART

In the aquatic field, there are several devices allowing assisting a swimmer in his/her movements. In particular, swimfins which allow facilitating swimming of divers by enlarging the surface pushing on the water. Nevertheless, conventional fin devices have limitations because they particularly load the ankles of the swimmers, and this result in fatigue injuries or sprains and strains.

Solutions allowing overcoming this problem exist such as that one described in document U.S. Pat. No. 3,268,927A in which there is described in particular a fin foil connected to a boot allowing keeping the ankle of the diver in a rest configuration, i.e. not involving it in the transmission of the pushing force. Thus, when swimming, the pushing force is generated by the diver directly by the muscles of the legs and tensions are no longer concentrated at the level of the ankles. In addition, in this solution, a walking configuration is provided for in which the fin is retracted towards the rear of the leg of the diver.

In practice, it arises that this solution allows only a limited propulsion. Moreover, this solution proves to be inconvenient to use.

Hence, it is an object of the present invention is to provide a reliable solution allowing overcoming the problem associated with the excessive loading of the ankles and allowing for an improved propulsion.

The other objects, features and advantages of the present invention will become apparent upon examining the following description and the appended drawings. It should be understood that other advantages could be incorporated.

SUMMARY OF THE INVENTION

To achieve this objective, according to one embodiment, an aquatic propulsion device is provided configured to be worn by a swimmer and comprising:

- a first portion configured to be securely attached to the leg of the swimmer, the first portion including a bearing part having an inner face shaped so as to bear on the tibia of the swimmer and an outer face opposite to the inner face,
- a second portion comprising a first foil and a foil support, the first foil being secured to the foil support and the foil support being configured to enable a rotational articulation of the second portion relative to the first portion according to a first axis X1 so as to alternately switch the device from:
- a deployed configuration in which the first foil is configured to extend substantially, in continuation of the direction of the tibia of the leg of the swimmer,
- a retracted configuration in which the first foil is positioned between the foot and the head of the swimmer so as to enable the swimmer to walk, the second portion then being folded opposite the outer face of the bearing part, The device being configured so that the first foil is positioned at a distance of at least 10 cm from the axis of rotation X1 so as to form in the second portion an opening enabling passage of the foot of the swimmer through said opening when the device alternates between the deployed configuration and the retracted configuration.

Thus, this allows providing the swimmer with a walking configuration in which the first foil is retracted forwards.

Indeed, the remote positioning of the foil with respect to the axis of rotation X1 forms an opening enabling an easy passage of the foot of the swimmer.

Without the present invention, the retraction of the first foil by rotation would be possible only rearwards because, with a forward rotation, the foot of the swimmer would abut against the foil and would prevent rotation thereof forwards.

The solutions of the prior art are unsatisfactory for several reasons and in particular because the used foils are dimensionally limited because once retracted towards the calf, they cannot rise higher than the knee without hindering the diver when he/she walks. Indeed, in the technical solutions in which the foil is retractable rearwards, its size is unavoidably constrained. A foil with an excessively large length is likely to abut against the rear of the thigh of the swimmer in a walking configuration. This problem is even more significant when there is a need for a large foil surface area or when the swimmer has a short tibia. Thus, these solutions are limited to foils with small dimensions, thereby offering a lower and necessarily less efficient propulsion force.

Thus, the present solution offers not only a walking configuration with the foil folded towards the front of the leg of the swimmer but also enables the use of foils with larger dimensions.

Hence, with the present solution, it is now possible to overcome the problem associated with the excessive loading of the ankles while enabling the use of a foil with large dimensions without hindering the walking motion of user.

Thus, the proposed solution allows improving the propulsion force while offering a simplified use, for example during an approach walk.

BRIEF DESCRIPTION OF THE FIGURES

The aims, objects, as well as the features and advantages of the invention will appear better from the detailed description of an embodiment of the latter which is illustrated by the following appended drawings, wherein.

Figure 1:
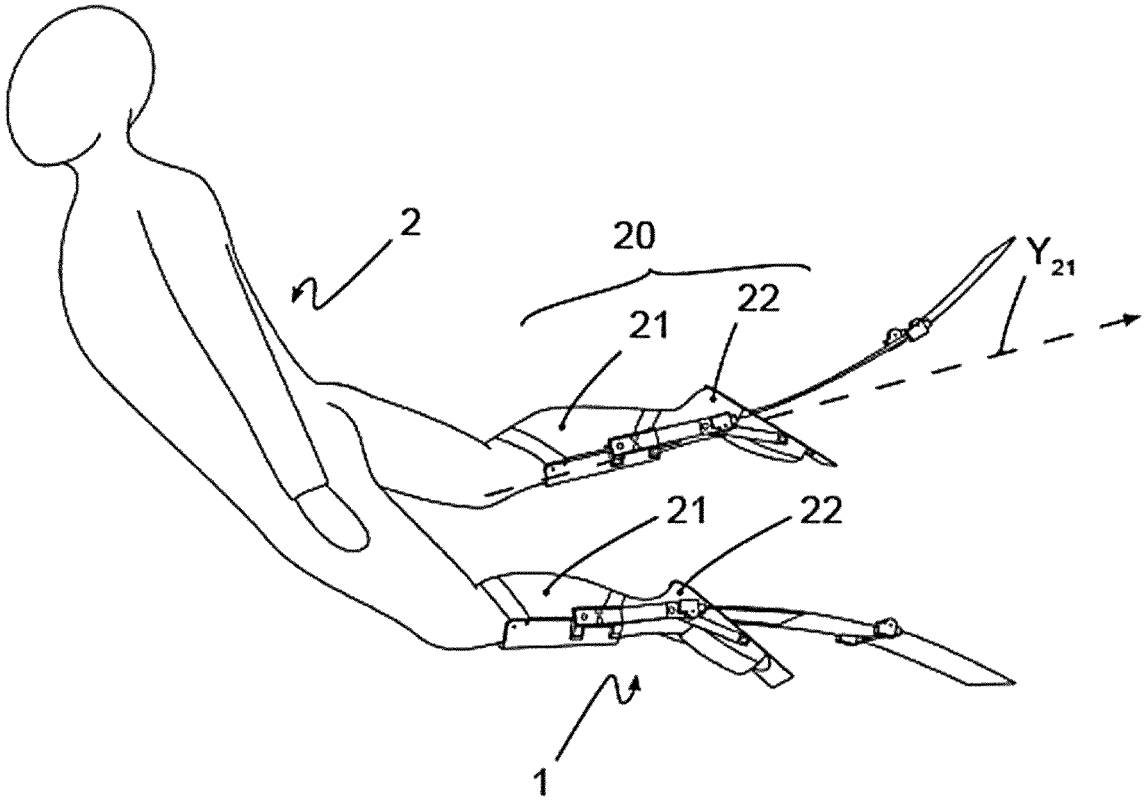
FIG. 1 shows a swimmer equipped at each leg with an example of a propulsion device according to the present invention in a swimming configuration.

The drawings are given as examples and do not limit the invention. They form block diagrams intended to facilitate understanding of the invention and are not necessarily plotted to the scale of practical applications.

DETAILED DESCRIPTION

Before starting a detailed review of embodiments of the invention, optional features are set out hereinafter, which could possibly be used in combination or alternatively:

According to one example, in the deployed configuration, the first portion extends according to a main direction Y11 substantially parallel to a preferred direction Y21 of extension of the tibia, and in the deployed configuration, the first foil extends according to the main direction Y11 of extension of the first portion.

According to one example, in the deployed configuration, the first foil extends according to a secondary main direction Y12, substantially parallel to the preferred direction Y21 of extension of the tibia.

According to one example, in a configuration worn by the swimmer, the axis of rotation X1 is located behind the tibia in projection according to an antero-posterior axis of the swimmer so that the axis of rotation X1 is located at the level of the malleoli of the swimmer in projection according to a longitudinal axis of the swimmer.

According to one example, the foil support can be elastically deformed during use under the effect of a finning force applied by the swimmer.

According to one example, the device comprises an intermediate member and a piece of equipment configured so as to wrap the foot of the swimmer at least partially, the intermediate member being rotatably articulated with the first portion according to a first intermediate axis X111, preferably the first intermediate axis X111 is parallel to the first axis X1, and the equipment being rotatably articulated with the intermediate member according to a second intermediate axis X113, preferably parallel to the axis of rotation X1.

According to one example, the equipment is an accessory, such as a slipper, comprising a closed loop configured to surround the foot of the swimmer, preferably at least at the level of the plantar arch.

According to one example, the device comprises a second foil secured to the equipment and configured to be positioned under the foot of the swimmer, the second foil having a widthwise dimension, according to the axis of rotation X1, substantially with the same size as the width of the equipment.

According to one example, comprising a removable connection mechanism between the first foil and the second foil so as to distribute the forces more finely between the tibia and the foot of the swimmer.

According to one example, the first foil is shaped so as to be more flexible than the foil support.

According to one example, the second portion comprises at least two foil supports, preferably distributed symmetrically on each side of the first foil and configured so as to support the first foil.

According to one example, the bearing part is curved and is configured to come into contact with the front of the leg of the swimmer and the first portion comprises an attachment system, preferably elastic strips, configured to enable holding of the bearing part in position against the front of the leg of the swimmer. Preferably, against the tibia of the swimmer.

According to one example, the device comprises a blocking system having a stop configured so as to enable stoppage of the rotation of the second portion relative to the first portion according to the axis of rotation X1 so as to limit the rotation in at least one amongst the deployed configuration and the retracted configuration.

According to one example, the device comprises a third portion comprising a first additional foil and an additional foil support, the first additional foil being secured to the additional foil support, the additional foil support being configured to alternately enable passage from an additional deployed configuration in which the first additional foil extends according to the main direction Y11 of extension of the first portion into an additional retracted configuration in which the first additional foil is in projection, entirely comprised in the plane of the first foil.

According to one example, in the deployed configuration, the first additional foil is located in continuation of the first foil.

According to one example, the device comprises an additional blocking system configured so as to enable blockage of the rotation of the third portion relative to the second portion according to the additional axis of rotation X1' so as to hold the third portion in position in an additional retraction configuration or in an additional deployment configuration.

According to one example, at least one foil is made of a composite material comprising glass fiber or carbon fiber.

According to one example, the device comprises an actuator which could be powered via an energy source so as to allow setting at least one foil support in rotation, relative to the first portion and according to a direction parallel to the axis of rotation X1.

According to one example, at least one foil has a profile shape whose section is symmetrically biconvex.

According to one example, the device comprising at least one sensor and an actuator configured to generate an oscillatory movement of the first foil according to the position of the leg of the swimmer or according to the oscillatory movement of the swimmer.

According to one example, the device comprises an assist system which comprises a motor, configured so as to enable a functional assistance to the swimmer in his/her finning movement.

It is specified that, in the context of the present invention, the term diver and/or swimmer could be understood as the user of the device. Consequently, it could be a human, an adult or a child. According to a very particular embodiment, it could consist of a robotic device or a robotic leg.

By "finning movement", it should be understood the movement necessary for the actuation of the device, it could be understood as a succession of oscillations of the legs of the swimmer.

In the following description, the term "on" does not necessarily mean "directly on". Thus, when it is indicated that a part or a member A bears "on" a part or a member B, this does not mean that the parts or members A and B are necessarily in direct contact with one another. These parts or members A and B may either be in direct contact or bear on one another via one or more other part(s). The same applies for other expressions such as for example the expression "A acts on B" which could mean "A acts directly on B" or "A acts on B via one or more other part(s)".

In the context of the present patent application, the expression "kinematically interposed between" does not necessarily mean "in contact with". Thus, if a part A is kinematically interposed between a part B and a part C, this does not mean that A and B are necessarily in direct contact or that A and C are necessarily in direct contact. This means that a movement or a force of the part B, respectively of the part C, could be transmitted at least partially to the part C, respectively to the part B, via the part A.

In the present patent application, the term movable corresponds to a rotational movement or to a translational movement or to a combination of movements, for example the combination of a rotation and a translation.

In the present patent application, when it is indicated that two parts are distinct, this means that these parts are separate. They are:

positioned at distances from each other, and/or movable relative to one another, and/or secured to each other while being fastened by affixed elements, this fastening could be demountable or not.

Hence, a one-piece part cannot consist of two distinct parts.

In the present patent application, the term "secured" used to describe the connection between two parts means that the two parts are connected/fastened with respect to each other, according to all degrees of freedom, except if is explicitly specified otherwise. For example, if it is indicated that two parts are secured in translation according to a direction X, this means that the parts could be movable relative to each other except according to the direction X. In other words, if a part is moved according to the direction X, the other part performs the same movement.

In the present patent application, an elastic means may for example be a spring, such as a coil spring, elastic washers such as Belleville washers, an elastomer, a rubber.

In the following detailed description, use may be made of terms such as "horizontal", "vertical", "longitudinal", "transverse", "upper", "lower", "up", "down", "front", "rear", "internal", "external". These terms should be interpreted relatively with regards to the position of the entire device worn by the swimmer and in a configuration in which the swimmer stands upright on the ground or underwater.

For example, the "horizontal" concept could also correspond to a direction parallel to the water or ground level.

The invention is not limited to the previously-described embodiments and covers all of the embodiments covered by the claims.

The present invention relates to an aquatic propulsion device configured to be worn by a swimmer. The use of this type of device is appropriate in particular for practicing scuba diving and prolonged swimming forces.

As illustrated in FIG. 1 and according to one example, when the swimmer 2 is in a swimming configuration, he/she is equipped simultaneously with two propulsion devices 1 respectively attached to his/her two legs.

Advantageously, the device 1 is configured so as to hold position against the leg 21 of the swimmer 2 at the level of the tibia while letting the foot 22 move freely.

Thus, the device 1 is configured to be worn on the leg 20 of the swimmer 2 and held in position. Preferably, the device 1 is able to be worn in the lower portion of the leg 20, namely in an area comprised between the ankle and knee.

Figure 2:
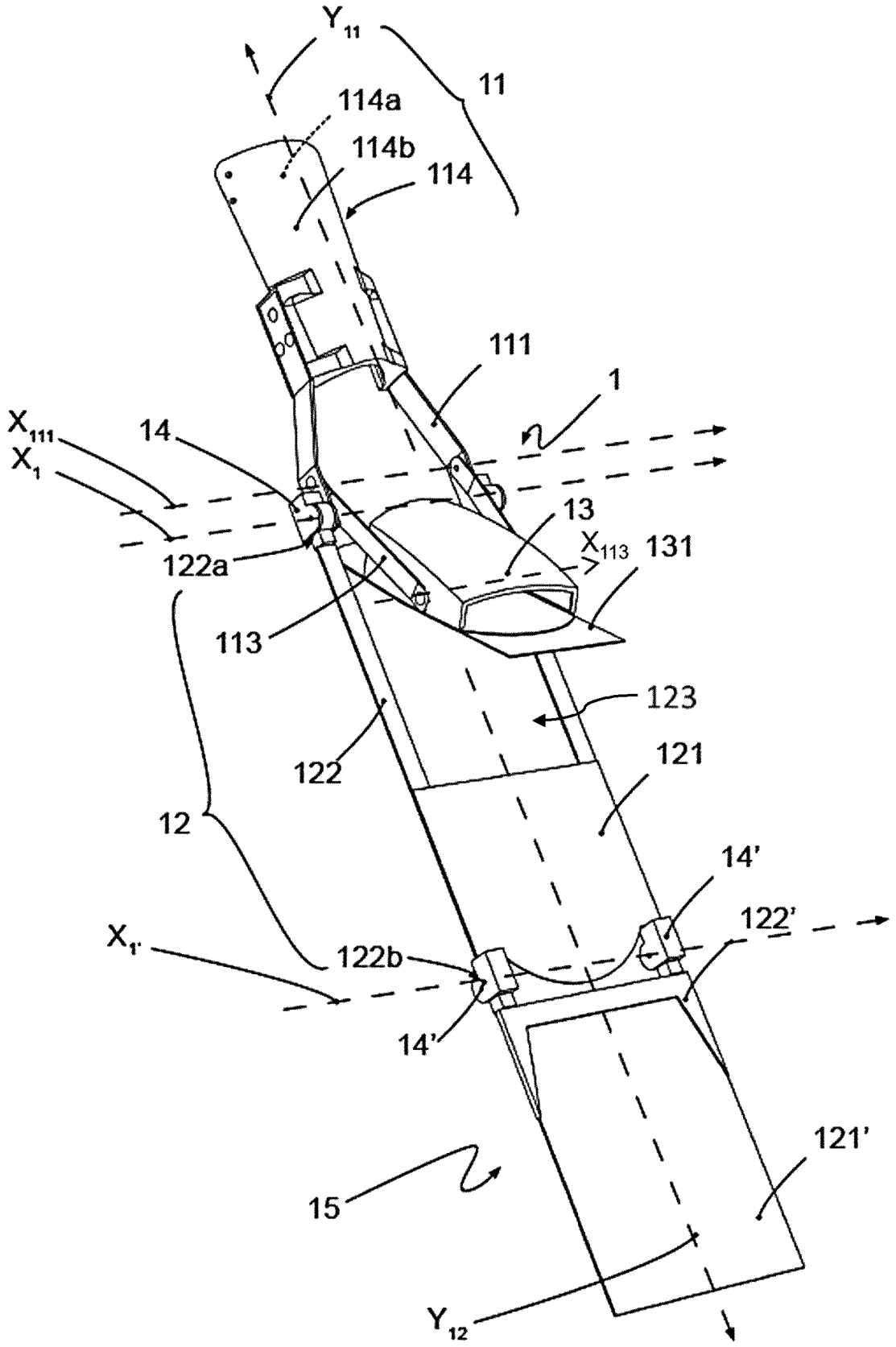
FIG. 2 shows an example of a propulsion device according to the present invention.

As illustrated in FIG. 2 and according to an example preferred by the present invention. The device 1 comprises a first portion 11 and a second portion 12. The first portion 11 is configured to enable holding of the device 1 in position on the leg 20. The second portion 12 being configured so as to rotatably articulate relative to the first portion 11 according to the axis of rotation X1.

First Portion

According to a particular embodiment, the first portion 11 comprises a bearing part 114. Advantageously, the bearing part 114 is carried by a rigid portion of the first portion 11. The bearing part 114 may have a concave surface.

The first portion 11 may be a removable part, configured to be securely attached to the leg 20 of the swimmer 2 and to be detached therefrom. The bearing part 114 having an inner face 114*a* shaped so as to bear against the tibia of the swimmer 2 and an outer face 114*b* opposite to the inner face 114*a*. Preferably, the inner face 114*a* being a concave surface.

Second Portion

The second portion 12 comprises a first foil 121 and a foil support 122, the first foil 121 being secured to the foil support 122 and the foil support 122 being configured to enable a rotational articulation of the second portion 12 relative to the first portion 11 according to the axis of rotation X1.

Preferably, when the device is worn by a swimmer, the axis of rotation X1 extends substantially according to the direction defined by the malleoli of the tibia and of the fibula of said swimmer.

Preferably, the second portion 12 is located opposite the plantar arch. The second portion 12 located in a portion of space delimited by a plane perpendicular to the direction of the tibia and passing through the plantar arch.

Kinematic Approach

Figure 3:
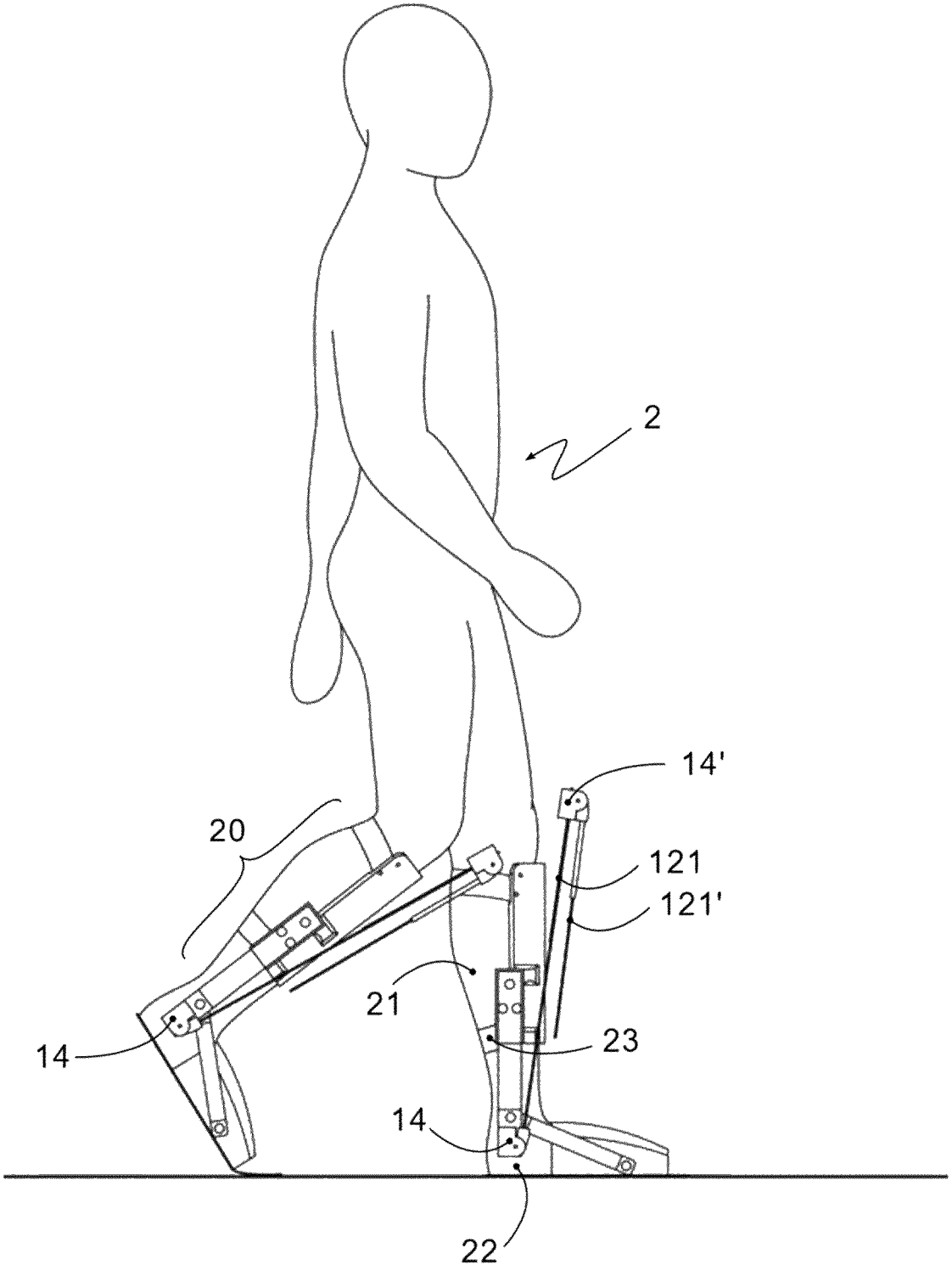
FIG. 3 shows a swimmer equipped with an example of a device according to the present invention in a walking configuration.
Figure 4A:
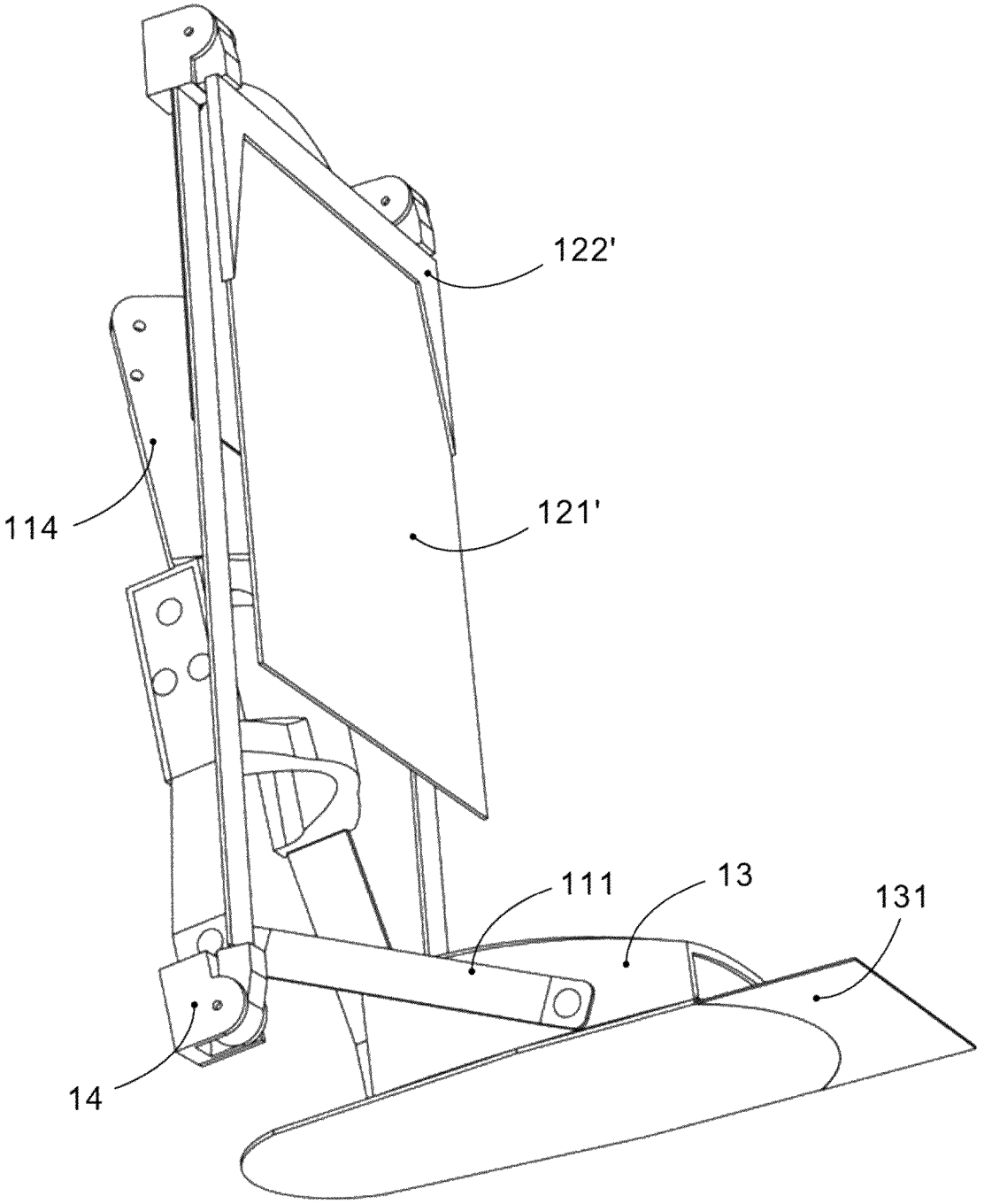
FIGS. 4A to 4B show an example of a device according to the present invention in different configurations.

The device 1 is configured so as to alternate between:

- a deployed configuration in which the first foil 121 is configured to extend substantially, in continuation of the direction of the tibia of the leg 21 of the swimmer 2. Preferably, the first foil 121 forms, with the secondary main direction Y12, a deployment angle $\alpha$ smaller than or equal to 90°, preferably smaller than 45°, preferably smaller than 20° or substantially equal to 0°.
- a retracted configuration, as illustrated in FIGS. 3 and 4, in which the first foil 121 is positioned between the foot 22 and the head of the swimmer 2 so as to enable the swimmer 2 to walk, the second portion 12 then being folded opposite the outer face 114*b* of the bearing part 114.

Foil Support

Preferably, each foil support 122 has:

- a proximal end 122*a* defining with the first portion 11 a pivot connection to form said rotational articulation of the second portion 12 relative to the first portion 11 according to the axis of rotation X1 and
- a distal end 122*b*.

The foil support 122 may be in the form of two profiled rods with a rectangular section.

Advantageously, the foil support(s) 122 are in contact with the bottom of the bearing element 114 so as to create a reaction point and thus enable the movement of the leg against the bearing element 114 to cause an angular movement of the first foil 12.

Preferably, the foil support(s) 122, 122' are parts having a plane of symmetry. Advantageously, the foil support(s) comprise(s) at least two rods, distributed in parallel around the foil.

Additional Foil

The device may also comprise a first additional foil 121' configured to rotatably articulate relative to the first foil 121. Preferably, the rotation is performed at the level of the distal end 122*b*. The device may comprise, at the distal end 122*b* of the foil support 122, a joint configured so as to enable the rotation of the first additional foil 121' relative to the first foil 121. The rotation could be performed according to a secondary axis of rotation X1'.

Preferably, the device comprises an additional blocking system 14' configured to preserve the alignment of the first foil 121 with the first additional foil 121'. The first foil 121 and the first additional foil 121' are substantially planar and are comprised between two parallel and preferably identical planes.

Alternatively, the foils are curved. They feature a continuity when passing from one to the other.

Space for the Passage of the Foot

The device 1 is configured so that the first foil 121 is positioned at a distance of at least 10 cm from the axis of rotation X1 so as to form, in the second portion 12, an opening 123 enabling passage of the foot 22 of the swimmer 2 through said opening 123 when the device 1 alternates between the deployed configuration and the retracted configuration.

Preferably, the distance is preferably at least 15 cm, preferably at least 20 cm, advantageously between 20 and 25 cm Said opening extends from the proximal ends in the direction of the distal ends. Preferably, the first foil 121 is supported by a distal portion 122*b* of the second portion 12, the distal portion 122*b* extending from the distal ends.

According to a particular embodiment, the first foil 121 extends along the foil support 122.

Preferably, the second foil 131 has a lengthwise dimension, perpendicular to the widthwise dimension, smaller than 30 cm, preferably the second foil extends under the equipment 13. The reduced dimension of the second foil 131 facilitating walking of the swimmer 2. This allows enlarging the plantar surface of the swimmer and thus further increasing the propulsion force when the water is pushed back with the foot sole.

Preferably, the second foil 131 is configured to be fastened by gluing under the equipment 13.

Advantageously, the reduced dimensions of the second foil 131 also enable the equipment 13 to pass through said opening when the device 1 alternates between the deployed configuration and the retracted configuration.

Additional Foil

According to a particular embodiment, the device comprises a first additional foil 121' configured to extend in continuation of the first foil 121 so as to enlarge the surface pushing against the water.

Functional Approach

In the deployed configuration, the device 1 is configured so that the foot of the swimmer 2 is located between the first portion 11 and the second portion 12. Preferably, in the deployed configuration, the main secondary direction of extension Y12 of the device 1 extends in continuation of the tibia of the swimmer 2. The device 1 is in a deployed configuration when the first portion 11 extends according to the main direction Y11 substantially parallel to a preferred direction Y21 of extension of the tibia and the first foil 121 extends parallel to the main direction Y11.

In the retracted configuration, the device 1 is preferably configured so that the second portion 12 is folded opposite the outer face 114*b* of the bearing part 114, preferably by coming into contact with the outer face 114*b*.

Preferably, the device features a rotational articulation of the third portion 15 relative to the second portion 12 according to an additional axis of rotation X1', parallel to the axis of rotation X1, alternatively, the first additional foil is configured to slide along the first foil 121.

Figure 4B:
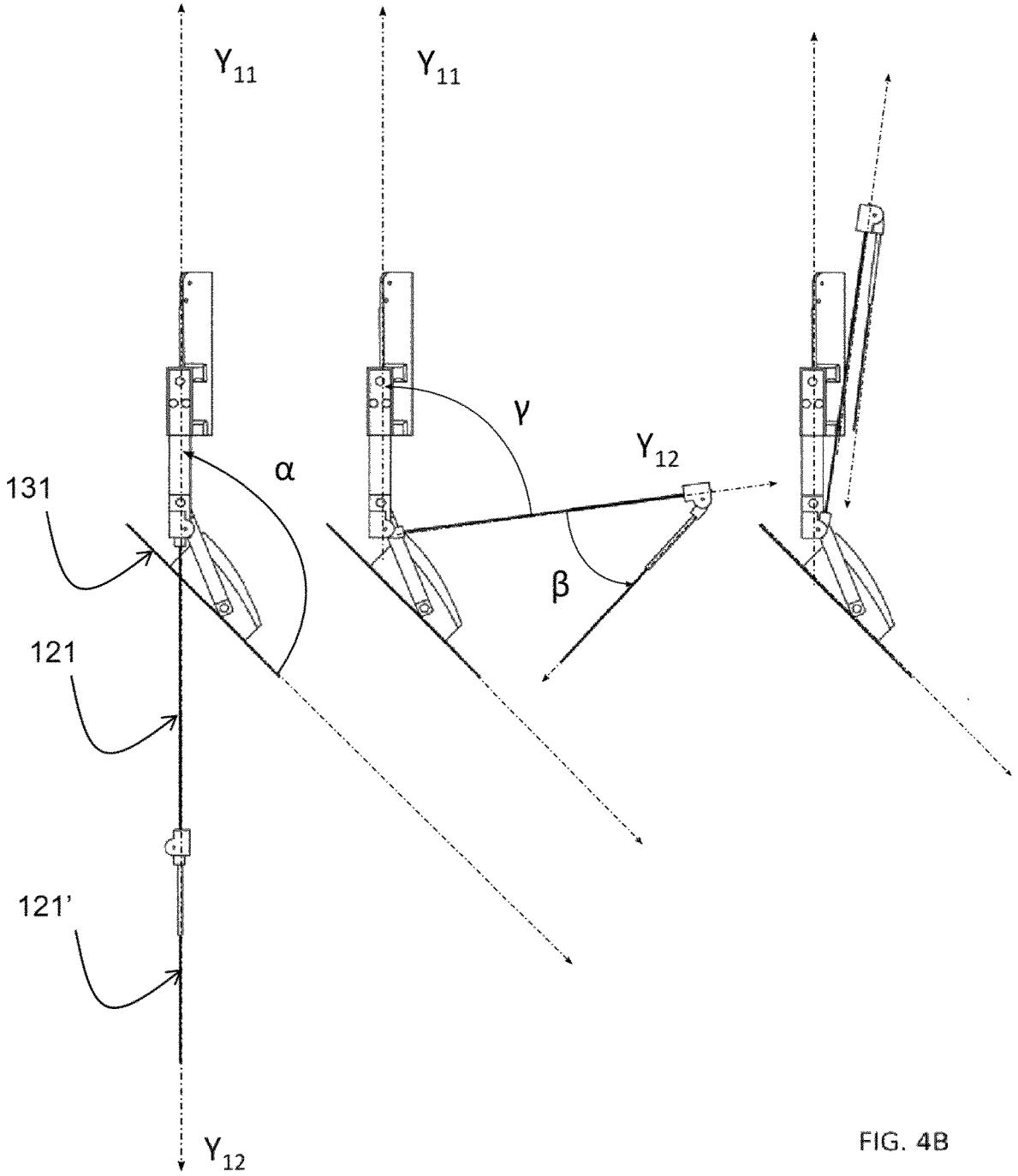

As illustrated in FIG. 4B and according to one example, the device is configured to enable a retraction of the first foil 121 and of the first intermediate foil 121'.

Preferably, according to a plane perpendicular to the axis of rotation X1:

- the second foil 131 is configured to be articulated according to a first displacement angle α with respect to the main direction Y11. Preferably, the third displacement angle γ is substantially 180° in the deployed configuration and is comprised between 0° and 45°, preferably between 0° and 20° in the retracted configuration
- the first additional foil 121' is configured to be articulated according to a second displacement angle β with respect to the secondary main direction Y12. Preferably, the third displacement angle β is substantially 180° in the deployed configuration and is comprised between 0° and 45°, preferably between 0° and 20° in the retracted configuration.

The first foil 121 is configured to be articulated according to a third displacement angle γ with respect to the main direction Y11. Preferably, the third displacement angle γ is substantially 180° in the deployed configuration and is comprised between 0° and 45°, preferably between 0° and 20° in the retracted configuration.

Intermediate Member

According to one example, the device comprises an intermediate member 113 and a piece of equipment 13 configured so as to wrap the foot 22 of the swimmer 2 at least partially, the intermediate member 113 being rotatably articulated with the first portion 11 according to a first intermediate axis X111, preferably the first intermediate axis X111 is parallel to the axis of rotation X1, and the equipment 13 being rotatably articulated with the intermediate member 113 according to a second intermediate axis X113, preferably parallel to the axis of rotation X1.

The intermediate member 113 may be in the form of a connecting rod having a rotational joint about the first intermediate axis X111 and a rotational joint about the second intermediate axis X113.

Advantageously, the equipment 13 is an accessory, such as a slipper, comprising a closed profile configured to surround the foot of the swimmer 2, preferably at least at the level of the plantar arch.

Materials and Strength

According to one example, the foil supports 122, 122' are shaped so as not to deform under the effect of their own weight.

According to one example, the foil supports 122, 122' are shaped so that, when they are submerged and are deformed under the effect of a finning force applied by the swimmer 2 and then this finning force is suppressed, they could return to their rest position.

Thus, the foil supports render to the device part of the force that has caused deformation thereof. This allows improving the performance of the device.

According to one example, the first foil 121 is made of a first material having a Young's modulus E1 and the foil support 122 is made of a second material having a Young's modulus E2, the materials being such that E1<E2.

According to a particular embodiment, the foils 121, 121' have a lower stiffness than the foil supports so that the foils are stiffened by the foil supports 122, 122'.

The Retractable Double Foil

According to one embodiment, the device comprises two foils articulated to one another; namely the first foil 121 and the first additional foil 121'. The two foils 121, 121' are mechanically articulated according to a pivot connection so as to enable the rotational movement of one of them relative to the other one. The double-foil system enables a semi-independent movement of each foil by enabling the first foil 121 to inscribe its pathway inside the first additional foil 121'.

Blocking System

According to a particular embodiment, the blocking system comprises a locking member configured to hold the device in position in the at least one amongst the deployed configuration and the retracted configuration.

According to a particular embodiment, the blocking system is located at a proximal end 122*a* of the foil support 122. Preferably, the blocking system 14 is a self-blocking pivot type device comprising hinge elements. It may include retractable unlocking lugs to enable the second portion 12 to rotate freely relative to the first portion 11.

Electrical Assistance

According to one embodiment, the device comprises an assist system comprising a motor, which could be a linear motor, configured so as to enable a functional assistance to the swimmer 2 in his/her finning movement.

Preferably, the device comprises at least one sensor which, as the swimmer 2 transmits a force to the foil support 122, it enables triggering of the linear motor and thus causes the retraction and the deployment of the foil support 122 in the direction of movement of the leg 20 of the swimmer 2 so as to assist the oscillatory movement of the leg 20 of the swimmer 2. Advantageously, the device comprising a linear winch configured so as to enable the deployment and the retraction of the first foil 121 according to a displacement angle. It could be a displacement angle smaller than 180°, preferably smaller than 120°.

Preferably, the assist system is configured to exert a push on the foil support 122 in order to accelerate the movement of the second portion 12 relative to the first portion 11.

According to one example, the device comprises a control unit configured to make the motor alternate cyclically between a forward movement and a backward movement in order to enable adaptation to the oscillations of the leg 20 of the swimmer 2.

The motor could be powered via an on-board energy storage device, for example rechargeable batteries. The device may further comprise several motors.

Foil With a Symmetrical Biconvex Profile

According to a particular embodiment, at least one foil amongst the first foil 121, the second foil 131 and the first additional foil 121' has a profile shape whose section is symmetrically biconvex. In particular, this enables the least turbulent possible swimming. The present invention combined with a foil with a symmetrically biconvex section allows recovering a powerful rotational movement about the axis of the knees of the swimmer 2 which allows developing an angular speed of the first foil 121, that is much higher than with a conventional palm. Advantageously, this angular speed is accentuated and converted into a push through the use of a foil with a symmetrical biconvex profile. Preferably, a profile with symmetrical biconvex section combined with the circular movement generates a higher flow speed on the side exposed to the direction of rotation, so-called the extrados, and a lower speed on the opposite side, so-called the intrados. This flow speed shift will create lift and amplify the angular speed of the foil. Thus, thanks to the device of the present invention, it is possible to amplify the performance of the propulsion and swimming techniques.

The Foil Connection

According to a particular embodiment, the device comprises a removable connection mechanism between the first foil 121 and the second foil 131. Indeed, this feature allows distributing more finely the forces between the tibia 21 and the foot 22 of the swimmer 2.

Preferably, the connection mechanism is removable. The connection mechanism may comprise a link member like a strap, a cord or an elastic. The connection could be done in a lower portion of the equipment, in particular in the portion of the equipment configured to be worn the closest to the foot of the swimmer 2. Preferably, the closest to the front of the foot of the swimmer in order to establish a connection between the foot tip of the swimmer and the foil 121. Thus, the connection mechanism enables an optimized distribution of the forces on the anterior portion of the body of the swimmer 2 as well as an adapted management of the deformation of the second foil during the rotational movements of the device 1.

According to a preferred embodiment, the device is configured so as to adapt to very different morphologies of swimmers proposing a distribution of the swimming forces between the foot and the lower portion of the leg. Hence, these elements characterize the invention in use thereof in the "swimming" mode, but the concept also allows innovations for use out of the water or a change of the medium.

OTHER EMBODIMENTS

According to a particular embodiment, the device 1 comprises sensors configured to activate triggering of an actuator in order to generate a movement of the foils according to the position of the leg of the swimmer 2 or according to the oscillatory movement of the swimmer 2.

The invention is not limited to the previously-described embodiments and covers all of the embodiments covered by the claims.

REFERENCES

1/aquatic propulsion device
11/first portion
113/intermediate member
114/bearing part
114*a*/inner face
114*b*/outer face
12/second portion
121/first foil
121'/first additional foil
122/foil support
123/opening
13/equipment
2/swimmer
20/leg
21/tibia
22/foot
23/attachments
X1/axis of rotation
Y11/main direction
X111/first intermediate axis
X113/second intermediate axis
Y12/secondary main direction
Y21/preferred direction

The invention claimed is:

1. An aquatic propulsion device configured to be worn by a swimmer and comprising:

a first portion configured to be securely attached to a leg of the swimmer, the first portion including a bearing part having an inner face shaped so as to bear on a tibia of the swimmer and an outer face opposite to the inner face, a second portion comprising a first foil and a foil support, the first foil being secured to the foil support and the foil support being configured to enable a rotational articulation of the second portion relative to the first portion according to an axis of rotation X1 to alternately switch the aquatic propulsion device from:

a deployed configuration in which the first foil is configured to extend substantially, in continuation of a direction of the tibia of the leg of the swimmer, and to a retracted configuration in which the first foil is positioned between a foot and a head of the swimmer to enable the swimmer to walk, the second portion then being folded opposite the outer face of the bearing part, wherein the first foil of the aquatic propulsion device is positioned at a distance of at least 10 cm from the axis of rotation X1 so as to form in the second portion an opening enabling passage of the foot of the swimmer through said opening responsive to the aquatic propulsion device alternating between the deployed configuration and the retracted configuration.

2. The aquatic propulsion device according to claim 1, wherein, in the deployed configuration, the first portion extends according to a main direction substantially parallel to a preferred direction of extension of the tibia, and in the deployed configuration, the first foil extends according to the main direction of extension of the first portion.

3. The aquatic propulsion device according to claim 1, wherein, in a configuration worn by the swimmer, the axis of rotation X1 is located behind the tibia in projection according to an antero-posterior axis of the swimmer so that the axis of rotation X1 is located at a level of a malleoli of the swimmer in projection according to a longitudinal axis of the swimmer.

4. The aquatic propulsion device according to claim 1, wherein the foil support elastically deforms during use under an effect of a finning force applied by the swimmer.

5. The aquatic propulsion device according to claim 1, further comprising an intermediate member and a piece of equipment configured to wrap at least partially around the foot of the swimmer, the intermediate member being rotatably articulated with the first portion according to a first intermediate axis X111, and the equipment being rotatably articulated with the intermediate member according to a second intermediate axis X113.

6. The aquatic propulsion device according to claim 5, wherein the equipment is an accessory, comprising a closed loop configured to surround the foot of the swimmer.

7. The aquatic propulsion device according to claim 5, further comprising a second foil secured to the equipment and configured to be positioned under the foot of the swimmer, the second foil having a widthwise dimension, according to the axis of rotation X1, with a same dimension as a width of the equipment.

8. The aquatic propulsion device according to claim 7, further comprising a removable connection mechanism between the first foil and the second foil to distribute the forces between the tibia and the foot of the swimmer.

9. The aquatic propulsion device according to claim 1, wherein the first foil is shaped to be more flexible than the foil support.

10. The aquatic propulsion device according to claim 1, wherein the second portion comprises at least two foil supports, each foil support configured to support the first foil.

11. The aquatic propulsion device according to claim 1, wherein the bearing part is curved and is configured to come into contact with a front of the leg of the swimmer and the first portion comprises an attachment system, configured to enable holding of the bearing part in position against the front of the leg of the swimmer.

12. The aquatic propulsion device according to claim 1, further comprising a blocking system having a stop configured to enable stoppage of the rotation of the second portion relative to the first portion according to the axis of rotation X1 to limit rotation in at least one amongst the deployed configuration and the retracted configuration.

13. The aquatic propulsion device according to claim 1, further comprising a third portion which comprises a first additional foil and an additional foil support, the first additional foil being secured to the additional foil support, the additional foil support being configured to alternately enable passage from an additional deployed configuration in which the first additional foil extends according to a main direction of extension of the first portion into an additional retracted configuration in which the first additional foil is projected, completely comprised in a plane of the first foil.

14. The aquatic propulsion device according to claim 13, configured so that, in the deployed configuration, the first additional foil is located in continuation of the first foil.

15. The aquatic propulsion device according to claim 13, further comprising an additional blocking system configured to enable blockage of the rotation of the third portion relative to the second portion according to an additional axis of rotation X1' to hold the third portion in position in an additional retraction configuration or in an additional deployment configuration.

16. The aquatic propulsion device according to claim 1, wherein at least one foil is made of a composite material comprising glass fiber or carbon fiber.

17. The aquatic propulsion device according to claim 1, further comprising an actuator adapted to be powered via an energy source to enable setting at least one foil support in rotational movement relative to the first portion and according to a direction parallel to the axis of rotation X1.

18. The aquatic propulsion device according to claim 1, wherein at least one foil has a profile shape whose section is non-planar.

19. The aquatic propulsion device according to claim 1, further comprising at least one sensor and one actuator configured to generate an oscillatory movement of the first foil according to the position of the leg of the swimmer or according to an oscillatory movement of the swimmer.

20. The aquatic propulsion device according to claim 1, further comprising an assist system which comprises a motor, configured to enable functional assistance to the swimmer in his/her finning movement.

* * * * *